US005336011A

United States Patent [19]

Ferguson et al.

[11] Patent Number: 5,336,011

[45] Date of Patent: Aug. 9, 1994

[54] STORAGE CAP WITH SPRING BIASED FEMALE THREADS

[75] Inventors: Gregory A. Ferguson, New Bedford; David Gallot, Fairhaven, both of Mass.

[73] Assignee: Precision Handling Devices Inc, Fall River, Mass.

[21] Appl. No.: 143,278

[22] Filed: Oct. 26, 1993

[51] Int. Cl.[5] ..... B43K 9/00

[52] U.S.-Cl. ..... 401/247; 401/202; 401/213; 401/243

[58] Field of Search ..... 401/243, 244, 245, 246, 401/247, 202, 213

[56] References Cited

U.S. PATENT DOCUMENTS

| | | |
|---|---|---|
| 427,444 | 5/1890 | Smith . |
| 1,042,695 | 10/1912 | Laughlin . |
| 1,423,448 | 7/1922 | O'Connor . |
| 1,517,411 | 12/1924 | Dewitt . |

FOREIGN PATENT DOCUMENTS

| | | | |
|---|---|---|---|
| 1006755 | 4/1957 | Fed. Rep. of Germany | 401/243 |
| 635537 | 4/1983 | Switzerland | 401/243 |
| 517388 | 1/1940 | United Kingdom | 401/246 |
| 839077 | 1/1957 | United Kingdom | 401/247 |

*Primary Examiner*—Steven A. Bratlie

*Attorney, Agent, or Firm*—M. Lukacher; R. Brown

[57] ABSTRACT

An improved protective storage cap for a rod-shaped device or instrument, particularly a fountain pen, wherein the female threads for securing the device within the cap are disposed within an axially and rotationally moveable ring. The ring is held stationary in the cap by the axial thrust of a compression spring while the male threads of the device are being rotationally engaged with or disengaged from the female threads of the cap. The cap cannot be overtightened and thereby damaged because further rotation of the device after full engagement of the threads serves only to overcome the restraining thrust of the spring and the moveable ring simply rotates in its cap with the device. The axial freedom of the ring and spring also permit the device to enter the cap to a depth sufficient to form a snap seal between the working end of the device and a chamber recessed within the cap, whereby the tool of the device, for example the writing nib of a fountain pen, sealingly is isolated from the outside environment. The pen body can be secured in the cap either by the snap seal alone or by the combination of the seal and the engaged threads. The cap can be stored on the non-working end of the device while the device is being used. Since the threaded ring is able to slide axially, its threads cannot be forced onto the non-working end, and thereby marring of the surface of the pen is prevented.

17 Claims, 6 Drawing Sheets

STORAGE CAP WITH SPRING BIASED FEMALE THREADS

DESCRIPTION

The present invention relates to an improved cap for protecting the working end of a rod-shaped device, instrument or tool, while in storage, and more particularly to a removable protective cap for a writing instrument. The invention provides a sealing, protective enclosure which can be snapped into place or screwed into place or both, without risk of damage to the instrument or the cap, and which can be stored on the non-working end of the instrument without marring the surface. The invention is especially suitable for use in providing an improved cap for a pen and particularly a fountain pen. The invention is also applicable to other tools and instruments such as scalpels, styli, and thermometers, as discussed hereinafter.

Fountain pens, and more recently ball point pens, are commonly used writing instruments. Both types of pens share common needs. The working end or tool of the instrument in the case of a pen is the writing nib. The nib, which feeds ink to and includes the tip which applies the ink to the substrate, must be protected from damage and also kept from drying out between uses. Equally important, the writer must be protected from ink leaks and stains on hands and clothing.

Protective caps which screw onto fountain pen bodies were disclosed long ago, as in, for example, U.S. Pat. Nos. 427,444; 1,042,695; 1,423,448 and 1,517,411. These patents also recognize the need to provide a positive seal for the writing nib within the cap in addition to the screw threads. This is in part to enclose a small, easily saturated environment in which the nib will not dry out between uses, and in part to isolate further the writer or bearer from inadvertent leaks of the nib in storage. Commonly employed as seals are either a mating ring and groove or a mating shoulder and stop on the pen body and within the cap.

A serious problem with known screw-cap designs has been a vulnerability to damage from over-tightening of the threads. With repeated abuse, these threads become stripped, making the cap useless as a container for the nib. Furthermore, for many years pens were made of hard rubber and later of brittle plastic, both of which were prone to split under the force of over-tightening, again ruining the usefulness of the cap. Thus, there exist today many pens which are still serviceable as writing instruments but which are in disuse because their caps are cracked or will not stay in place. Accordingly, it is a feature of the invention to provide a pen cap for old or new pens which can be made of plastic or metal and will engage fully with male threads of a pen body but which cannot be damaged by over-tightening and will be easily unscrewed. A further feature of the invention is to provide a pen cap which can be snapped onto a pen body, or screwed on, or both at once.

Another shortcoming of known designs is the tendency for the female threads in the cap to mar the surface of the non-working end of the pen when the cap is stored on that end while the pen is in use. Even a pen body tapered to match the taper in the female threads of the cap will be damaged by repeated placement and removal of the cap on the non-working end of the pen. Thus, a further feature of the invention is to provide a pen cap which will not mar the pen body surface in cap storage position.

Numerous other types of rod-like devices, for example, scalpels or knives, thermometers, electrodes, mechanical pencils, styli, and the like, have tools on their working ends and can also utilize a storage cap to protect both the tool from damage and/or the user from injury. Thus, caps for these devices in accordance with this invention are protected against over-tightening, and will not mar the non-working ends of such devices when stored thereon.

Briefly described, a storage cap in accordance with the invention utilizes within the cap a ring having female threads on its inner surface, which ring is capable of rotary and axial movement relative to the shell of the cap. In a preferred embodiment, the ring is smooth on its outer surface. A coil spring in partial compression within the cap lightly forces the threaded ring against a retainer near the open end of the cap. Within the closed end of the cap, behind the spring, is a small chamber which constitutes a snap-fit tubular cover for the tool of the device, in the case of a pen, the writing nib. The snap-fit cover has an annular groove at its outer end which is sized to mate removably with a mating ring on the device body, and is located in relation to the inner end of the chamber such that the tool itself is shrouded and sealed from the outside environment without contacting the tubular cover.

To make the snap-fit seal, the working end of the device engages and axially displaces slightly the female-threaded rotatable ring. The snap-fit seal is sufficient by itself to retain the cap on the device. However, rotation of the body of the device within the cap will serve to engage the male and female threads, whether or not the snap-fit seal has been made previously. The female-threaded ring is prevented from rotating by the axial thrust of the spring until the threads are fully engaged. Further rotation of the body serves only to begin turning the threaded ring within the cap shell, and therefore overtightening of the threads and consequent damage to the cap is impossible. Since the threads cannot be overtightened, they are easily disengaged by counter-rotation of the body relative to the cap, the thrust of the spring again keeping the threaded cylinder from turning.

In accordance with another embodiment of the invention, a more positive action is obtained by incorporating axially asymmetrical fins on the outer surface of the threaded cylinder, which fins mate with splines or grooves on the inner surface of the shell. This provides a ratchet mechanism which prevents application of excessive pressure to the threads during tightening but provides a positive stop to counter-rotation of the cylinder while the threads are being disengaged.

In both embodiments, the female-threaded ring is free to be displaced axially by the entrance of the non-working end of the device into the cap. Thus, the threads are in only light and resilient contact with the body of the device and will not mar its surface. Preferably, the female-threaded ring is made of a plastic such as nylon which further ensures the safety of the surface from damage. The cap is held onto the device by the friction of a small ring axially disposed within the shell near the open end of the cap, the ring having an axial taper matching that of the device body.

The foregoing and other features, objects, and advantages of the invention will become more apparent from a reading of the following description in connection with the accompanying drawings in which.

Figure 1:
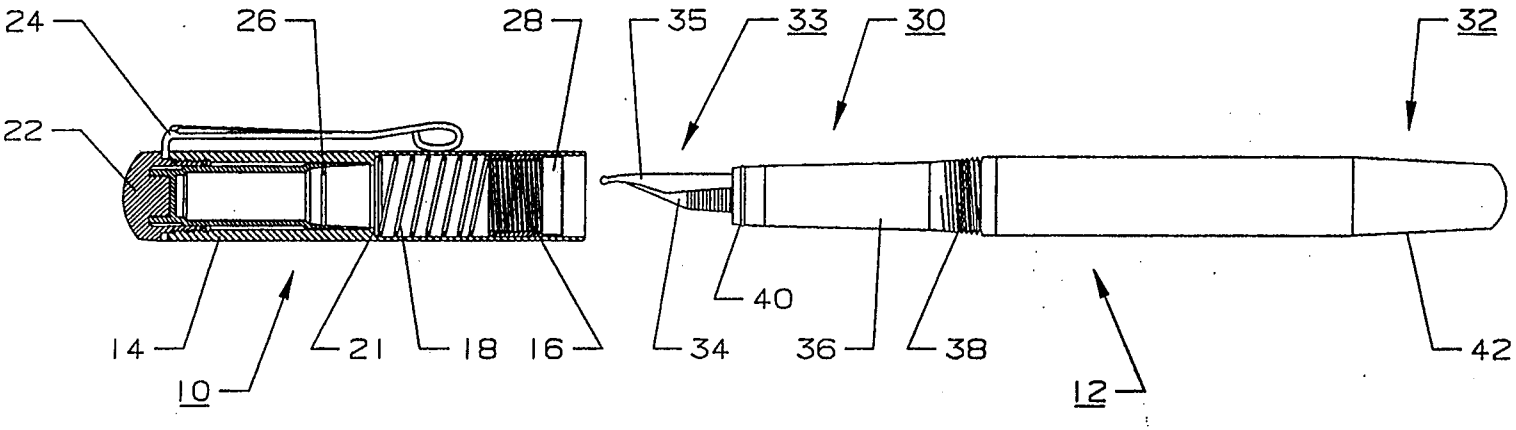
FIG. 1 is a side view of a fountain pen and cap therefor, the cap being shown in cross-section, in accordance with a preferred embodiment of the invention.
Figure 4:
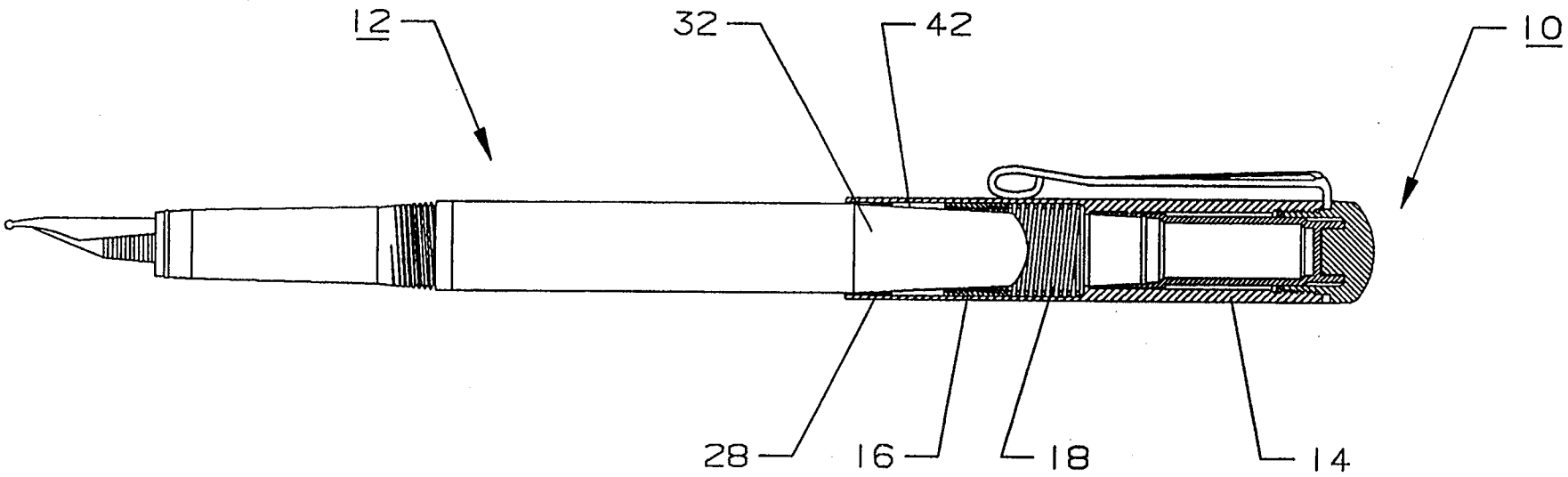
FIG. 4 is a side view which shows the cap illustrated in FIG. 1 in storage position on the tapered portion of the non-working end of the pen body, with the spring-loaded female-threaded ring axially depressed to prevent marring of the body by the threads of the cap.

Referring to the figures in which like numbers indicate like parts and particularly to FIG. 1, there is shown a fountain pen 30 and its cap 10, in accordance with the invention. The pen which is a preferred embodiment has a body 12 which is substantially cylindrical and has a working end 33 and a non-working end 32. Working end 33 comprises a writing nib 35 having an ink feeder 34 and a writing point. The body 12 has a non-threaded portion 36, and a threaded portion 38 on its outer periphery ("male" threads). An annular sealing ring is provided by a ridge 40 on the periphery of working end 33 adjacent to writing nib 35, which also can be a ball-point nib or a felt-tip nib. Cap 10 has a generally cylindrical shell 14 made of metal or plastic which is adapted to receive the other components of the cap 10. Cylindrical ring 16 is disposed in the shell 14 of the cap 10 for both axial and rotational movement, and has threads on its inner surface ("female" threads) like a nut for a bolt. Ring 16 is preferably made of a resilient plastic such as, for example, nylon. Ring 16 is captured in the shell 14 by retaining ring 28 which is secured in place by, for example, adhesive or friction against the inner periphery of the shell 14. Retaining ring 28 is also preferably made of a resilient plastic and is slightly tapered axially on its inner surface to allow it to mate properly with the tapered portion 42 of non-working end 32 of pen body 12 when cap 10 is in its storage position, as shown in FIG. 4.

Also within shell 14 is a snap-fit sleeve which provides cover 20. The cover is seated against shoulder 21 and retained in shell 14 by cover retainer 22. Cover 20 is made preferably of a resilient plastic, e.g. nylon. Cover 20 contains annular sealing groove 26 on its inner surface and is slightly tapered in its outer diameter in the region of the groove such that cover 20 can expand slightly as annular sealing ridge 40 mates with sealing groove 26 to provide a positive, but easily releasable, seal for writing nib 35 in cover 20. This prevents ink on writing nib 35 from drying out while pen 30 is not being used and also keeps any leaked ink within cover 20. Cover 20 is also free to rotate within shell 14 which minimizes rotational drag when cap and body are being screwed together or unscrewed.

FIG. 1 also shows a pocket clip 24 for holding the capped device in a user's pocket. Clip 24 comprises a biased leaf spring and a ring, which ring is secured to cap 10 by being captured between cover retainer 22 and shell 14.

Also within shell 14 is spring 18 which is disposed in partial compression between shoulder 21 and ring 16, thereby urging ring 16 lightly against retaining ring 28.

Figure 2:
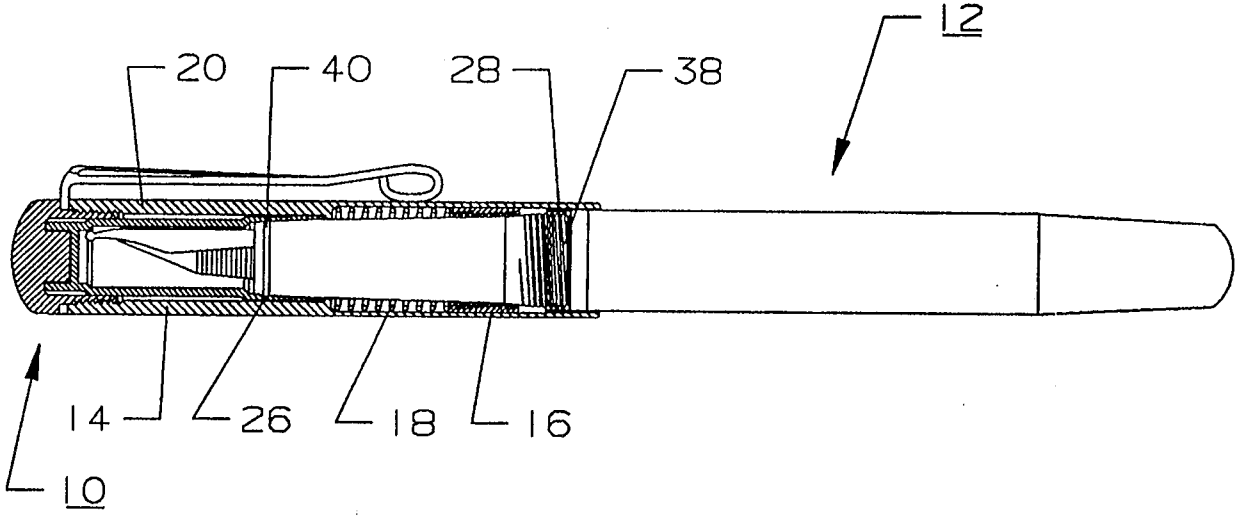
FIG. 2 is a side view which shows the fountain pen of FIG. 1 inserted in snap-fit relationship into the cap of FIG. 1, with the cylindrical female-threaded ring and spring axially depressed and the threads not engaged.

FIG. 2 shows pen cap 10 and pen body 12 in snap-fit engagement. Body 12 has entered cap 10, axially depressing ring 16 and spring 18, and has reached its limit of axial engagement with cap 10 by the mating of sealing ridge 40 in sealing groove 26. Writing nib 35 is held safely and sealed from the outside environment within snap-fit cover 20. Pen body 12 and cover 20 can now rotate as a sealed unit, to be separated only by axial force applied by the user to open the pen for writing. In FIG. 2, the female threads of the cap and the male threads of the body are aligned for mating by rotation, but are not yet engaged.

Figure 3:
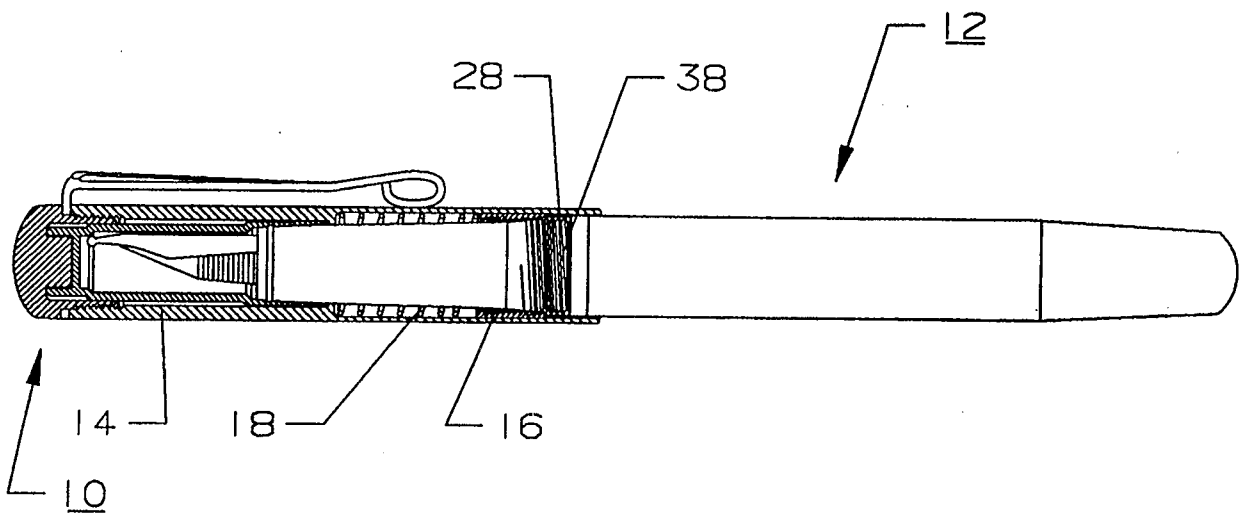
FIG. 3 is a view similar to FIG. 2 which shows the pen after the body of the pen has been rotated relative to the cap and the male and female threads are engaged.

FIG. 3 shows the threads of the cap and body fully engaged, along with the snap-fit seal. Threaded ring 16 and spring 18 have been drawn axially to their original positions by the action of engaging the threads.

FIG. 4 shows pen 12 in working mode with cap 10 removed and stored on non-working end 32. Tapered retaining ring 28 grips end 32 firmly but without marring its surface. Threaded ring 16 and spring 18 are again depressed axially to prevent the female threads from being forced onto taper 42 and thereby marring its surface. Cap 10 thus can be placed in storage on end 32 and removed through many cycles without damaging the surface of pen body 12.

Figure 5:
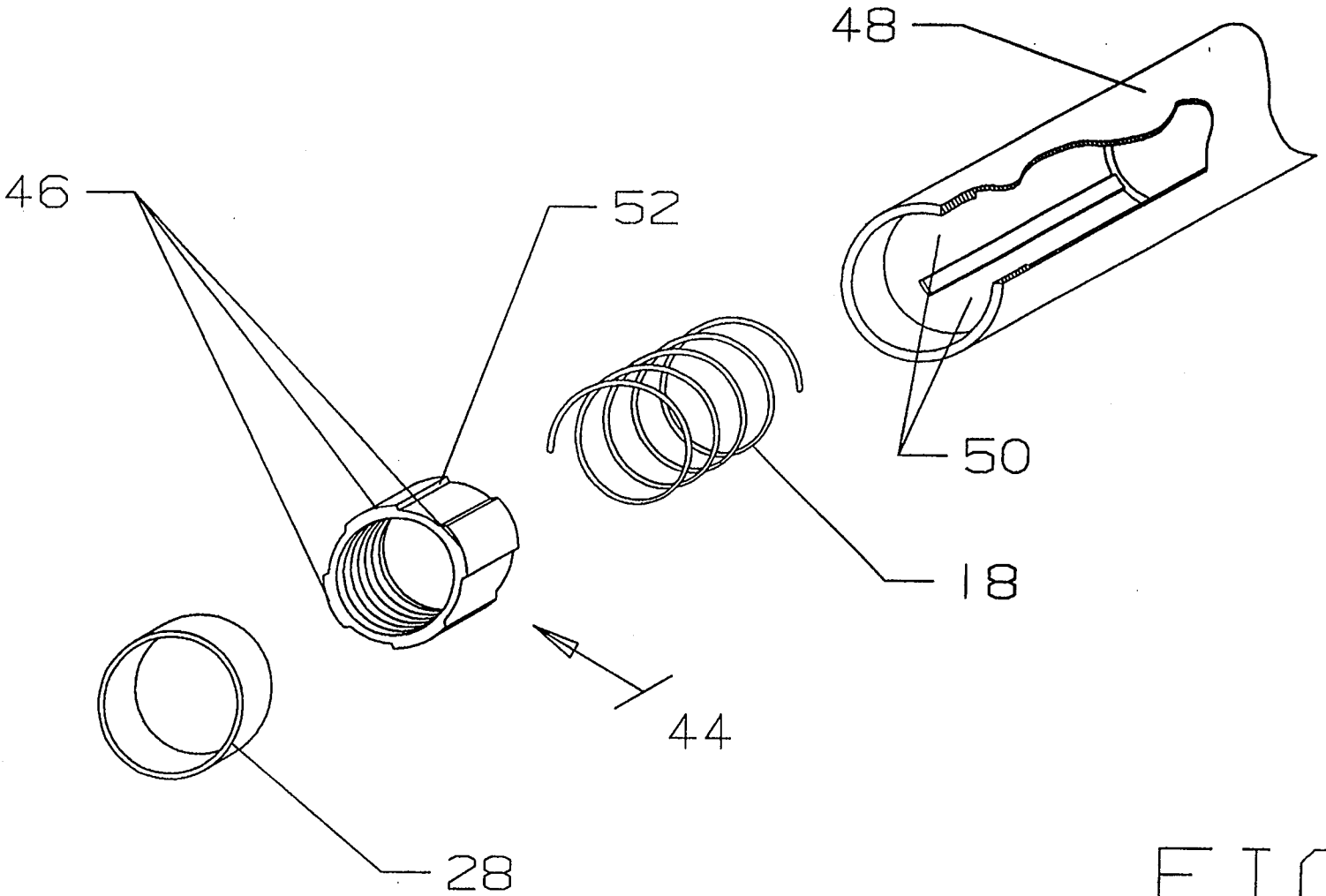
FIG. 5 is a simplified exploded perspective view of a cap in accordance with another embodiment of the invention.

FIG. 5 shows details of an alternative embodiment of pen cap 10. In place of female-threaded ring 16 in FIGS. 1–4, a differently designed ring 44 is similarly disposed in cap 10. Ring 44 is female-threaded on its inner surface and carries longitudinal fins 46 on its outer surface. Cylindrical shell 14 in FIGS. 1–4 is replaced by cylindrical shell 48, which is similar dimensionally to shell 14 and additionally has a plurality of grooves 50 longitudinally disposed in its inner surface. Grooves 50 are longer than the axial length of ring 44. Ring 44 is chamfered 52 at one end, and fins 46 are easily flexible in the thread-tightening direction of rotation. The chamfer 52 and the flexibility of fins 46 permits easy assembly of ring 44 into shell 48, where fins 46 snap into grooves 50 and whereby ring 44 becomes captive in shell 48. The combination of ring 44 and shell 48 effectively acts as a ratchet, permitting rotation of ring 48 to prevent over-tightening of the threads but preventing reverse rotation of ring 48 when the threads are being disengaged. All other elements of the embodiment shown in FIGS. 1–4 are common to this embodiment, only details of variations of which are shown in FIG. 5.

Figure 6:
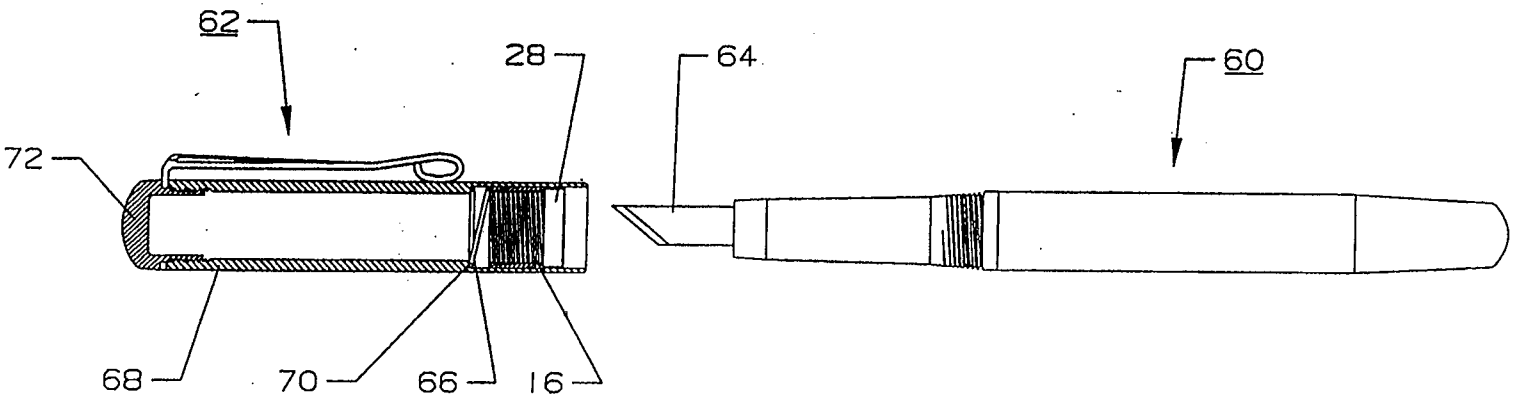
FIG. 6 is a side view of a scalpel and cap therefor, the cap being shown in cross-section, in accordance with an embodiment of the invention.

FIG. 6 shows another embodiment of a cap of the invention wherein a snap-fit environmental seal for the tool of the working end is not needed as, for example, for a stylus, a scalpel, or a thermometer. In this embodiment, a device 60 is shown which is similar to pen body 12 in FIGS. 1–4 but lacks annular sealing ridge 40. In cap 62, snap-fit cover 20 is omitted entirely. Threaded ring 16 and ring retainer 28 are identical with those in FIGS. 1–4, while spring 66, shell 68, shoulder 70, and cover 72 are analogs of spring 18, shell 14, shoulder 21, and cover retainer 22, respectively. Preferably, spring 66 is much shorter than spring 18 to reduce the permissible axial movement of ring 16 and thereby to prevent blade 64 from contacting cover 72. The mechanism of cap 62 functions identically with that of cap 10 to prevent thread damage by overtightening and to prevent marring of the non-working end of device 60.

From the foregoing description, it will be apparent that there has been provided an improved protective cap for the working end of a pen (its tool), and particularly for the writing nib of a fountain pen. Variations and modifications in the herein described designs, and additional uses and applications therefor within the scope of the invention, will undoubtedly suggest themselves to those skilled in the art. Accordingly, the foregoing description should be taken as illustrative and not in a limiting sense.

What is claimed is:

1. A removable storage cap for protecting a tool on the working end of an instrument, a non-threaded portion, an annular sealing ridge, and a male-threaded portion spaced from said tool along said working end and on an external periphery of said working end, said storage cap comprising:

a. a cylindrical shell having a closure at a first end and being open at a second end to admit said instrument;

b. means for limiting the depth of ingress of said instrument into said shell to prevent said tool from contacting said closure;

c. a cylindrical ring disposed coaxially within said shell for rotational and axial movement with respect to said shell, said ring having on its inner surface a female-threaded portion mateable with said male-threaded portion of said working end upon insertion and rotation of said instrument in said cap;

d. a coil spring disposed coaxially in partial compression within said shell between said ring and said closure, the force of said spring against said ring being such that when said instrument is inserted into said cap and rotated, said ring is held without turning while said male and female threads are being engaged or disengaged and said ring is permitted to turn only in response to further engaging rotation of said device whereby damage to said threads is prevented.

2. A storage cap according to claim 1 wherein said closure comprises a hollow snap-fit tubular cover disposed coaxially and rotatably within said shell between said first end and said spring and having a portion in sealing mating relationship with said working end.

3. A storage cap according to claim 2 further comprising an annular groove in the inner wall of said snap-fit cover which provides said sealing mating relationship with said annular sealing ridge on the working end of said instrument.

4. A storage cap according to claim 3 wherein said cylindrical ring further comprises a plurality of longitudinal fins on its outer periphery and said shell further comprises longitudinal grooves on its inner periphery, said fins and grooves defining a ratchet and cooperating to permit rotation of said ring in the direction of engagement of said threads and to prevent rotation of said ring in the opposite direction.

5. A storage cap according to claim 4 wherein said longitudinal grooves are longer than the axial length of said cylindrical ring, allowing said ring to be depressed axially in said shell by ingress of said working end, whereby said working end may be secured in said cap by mating of said annular sealing ridge into said annular groove, or by rotational mating of said male and female threads, or both.

6. A storage cap according to claim 1 further comprising a pocket clip disposed at said first end of said cylindrical shell.

7. A storage cap according to claim 1 further comprising means for retaining said cylindrical ring within said cylindrical shell.

8. A storage cap according to claim 7 wherein said retaining means comprises a retaining ring.

9. A storage cap according to claim 2 further comprising a retainer for said snap-fit cover, said retainer being held in said shell.

10. A device for writing, comprising a. a rod-shaped body, further comprising i) a non-working end, and ii) a working end having a writing nib which extends therefrom, an annular sealing ring adjacent to said nib, a non-threaded portion, and a male threaded portion spaced at a distance from said nib on an external periphery of said working end; and b. a protective storage cap, which is removed when said device is to be used for writing, said cap further comprising i) a cylindrical shell having a closure at a first end and being open at a second end to admit said working end of said rod-shaped body;

ii) means for limiting the depth of ingress of said working end into said shell to prevent said nib from contacting said closure;

iii) a cylindrical ring disposed coaxially within said shell for rotational and axial movement with respect to said shell, said ring having on its inner surface a female threaded portion mateable with said male-threaded portion of said working end upon insertion of said male-threaded portion into said ring and rotation of said body;

iv) a coil spring disposed coaxially in partial compression within said shell between said ring and said closure;

v) a hollow snap-fit tubular cover disposed coaxially and rotatably within said shell between said first end and said spring and having an annular groove in sealing mating relationship with said annular sealing ring on said working end when said writing nib is inserted into said tubular cover.

11. A writing device according to claim 10 wherein said working end is selected from the group consisting of a fountain pen nib, a ball point pen nib, a tip from a pencil lead which extends, and a stylus.

12. A writing device according to claim 10 further comprising means for securely storing said removable cap when desired on said non-working end of said device without damage to the surface of said non-working end.

13. A writing device according to claim 12 wherein said storing means comprises:

a. a tapered portion on the periphery of said non-working end;

b. a ring fixed on the inner surface of said shell between said axially moveable female-threaded cylindrical ring and said open end of said shell, said fixed ring being tapered on its inner surface to match said taper on said non-working end, and said female-threaded ring being axially displaceable by insertion of said non-working end into said cap, said tapered ring being mateable with said tapered non-working end.

14. A removable storage cap for protecting a tool on the working end of an instrument, a non-threaded portion, and a male-threaded portion spaced from said tool along said working end and on an external periphery of said working end, said storage cap comprising:

a. a cylindrical shell having a closure at a first end and being open at a second end to admit said instrument;

b. means for limiting the depth of ingress of said instrument into said shell to prevent said tool from contacting said closure;

c. a cylindrical ring disposed coaxially within said shell for rotational and axial movement with respect to said shell, said ring having on its inner surface a female-threaded portion mateable with said male-threaded portion of said instrument upon insertion and rotation of said instrument in said cap;

d. a coil spring disposed coaxially in partial compression within said shell between said ring and said closure, the force of said spring against said ring being such that when said instrument is inserted into said cap and rotated, said ring is held without turning while said male and female threads are being engaged or disengaged and said ring is permitted only to turn in response to further engaging rotation of said instrument whereby damage to said threads is prevented.

15. A storage cap according to claim 14 further comprising a pocket clip disposed at said first end of cylindrical shell.

16. A storage cap according to claim 14 further comprising means for retaining said cylindrical ring within said cylindrical shell.

17. A storage cap according to claim 16 wherein said retaining means comprises a retaining ring.

* * * * *